US010124815B2

(12) United States Patent
Drexler et al.

(10) Patent No.: US 10,124,815 B2
(45) Date of Patent: Nov. 13, 2018

(54) CENTRAL CLIMBING PROTECTION FOR RAIL VEHICLES WITH ADDITIONAL FUNCTIONS

(71) Applicant: SIEMENS AKTIENGESELLSCHAFT, Munich (DE)

(72) Inventors: Stephan Drexler, Sauerlach (DE); Manuel Kroiss, Ebersbach (DE); Hannes Peer, Munich (DE); Christian Winkelmann, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 207 days.

(21) Appl. No.: 15/025,310

(22) PCT Filed: Sep. 27, 2013

(86) PCT No.: PCT/EP2013/070202
§ 371 (c)(1),
(2) Date: Mar. 28, 2016

(87) PCT Pub. No.: WO2015/043651
PCT Pub. Date: Apr. 2, 2015

(65) Prior Publication Data
US 2016/0221587 A1 Aug. 4, 2016

(51) Int. Cl.
*B61D 15/06* (2006.01)
*B61F 1/10* (2006.01)
*E01H 8/04* (2006.01)

(52) U.S. Cl.
CPC ..... *B61D 15/06* (2013.01); *B61F 1/10* (2013.01); *E01H 8/04* (2013.01)

(58) Field of Classification Search
CPC ..... B61D 15/00; B61D 15/06
See application file for complete search history.

(56) References Cited

U.S. PATENT DOCUMENTS 5,879,699 A * 3/1999 Lerner ..... A61K 9/0056 424/439
6,561,105 B2 * 5/2003 Godin ..... B61C 17/04 105/392.5
7,597,052 B2 10/2009 Malfent et al.
(Continued)

FOREIGN PATENT DOCUMENTS

EP 0888946 A1 1/1999
EP 1070791 A2 1/2001
EP 1468890 A1 10/2004
(Continued)

*Primary Examiner* — Robert J McCarry, Jr.
(74) *Attorney, Agent, or Firm* — Laurence Greenberg; Werner Stemer; Ralph Locher

(57) ABSTRACT

A rail vehicle includes a chassis, a vehicle structure and a support unit disposed at the end face of the rail vehicle. The vehicle is comparatively lightweight and economical and can also advantageously perform other tasks in addition to supporting a track reamer. The support unit includes a plateau section which is part of the vehicle structure and includes a climbing protection device on its end face and a track reamer holder for supporting a track reamer. The track reamer holder is disposed below the plateau section and is rigidly secured thereto.

3 Claims, 1 Drawing Sheet

(56) References Cited

U.S. PATENT DOCUMENTS 7,690,314 B2 * 4/2010 Clark ..... B61D 15/06
105/392.5

FOREIGN PATENT DOCUMENTS

| | | | |
|---|---|---|---|
| JP | 58003363 | A | 10/1983 |
| SU | 5306 | A1 | 5/1928 |
| WO | 2006010176 | A1 | 2/2006 |

* cited by examiner

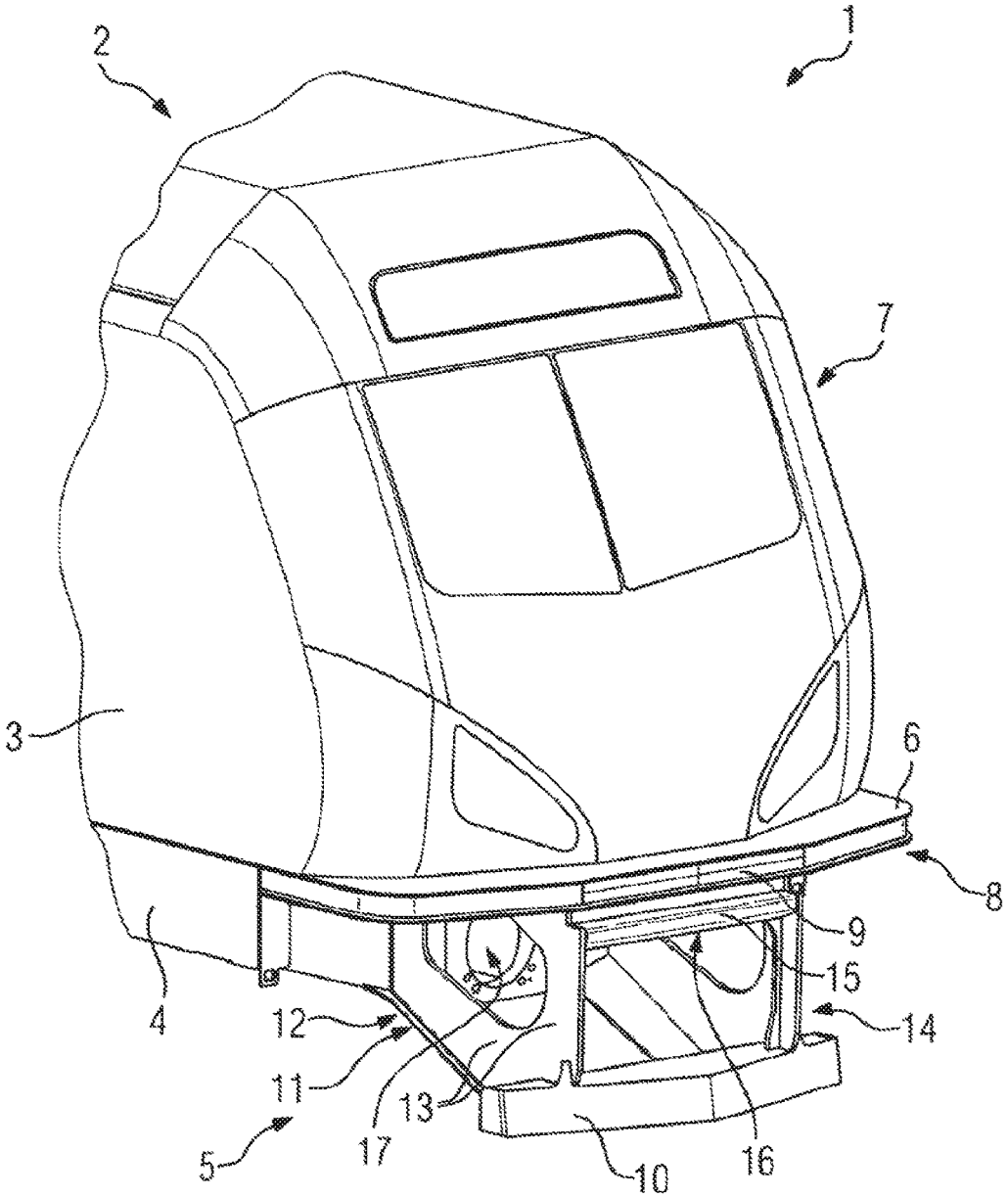
1
2
7
3
6
8
9
15
14
4
12
11
13
17
5
10
16

CENTRAL CLIMBING PROTECTION FOR RAIL VEHICLES WITH ADDITIONAL FUNCTIONS

BACKGROUND OF THE INVENTION

Field of the Invention

The invention relates to a rail vehicle with a chassis, a vehicle structure and a support unit disposed on the end face of the rail vehicle.

A rail vehicle of this type is already known from EP 1 070 791 A2. The rail vehicle disclosed in said document is equipped with a track reamer, which is disposed below the support frame of the rail vehicle. A bracket consisting of a circular upper plate, a hollow circular cylinder, a support plate welded to the circular cylinder in a fixed manner as well as a cross member, serves to hold the track reamer on the support frame. The aforementioned bracket bears the disadvantage that this is complex to manufacture, heavy and cost-intensive. Moreover, the bracket only serves a single purpose, namely the support of the track reamer.

BRIEF SUMMARY OF THE INVENTION

It is the object of the invention to provide a rail vehicle of the type mentioned in the introduction, which is comparatively lightweight and cost-effective and in addition to the support of a track reamer is also beneficial for further objects.

The invention achieves this object by the support unit having a plateau section which is part of the vehicle structure and has climbing protection means on its end face, wherein below the plateau section a track reamer holder is disposed for holding a track reamer, which track reamer holder is connected to the plateau section in a fixed manner.

The inventive rail vehicle is equipped with a support unit which is part of the vehicle structure and is embodied in an extremely robust manner. It is disposed on the end face of the rail vehicle and thus points forward in the direction of travel. The direction of travel of the rail vehicle is designated the longitudinal direction here. The transverse direction runs in a horizontal to the plane at a right angle to the longitudinal direction. The horizontal plane runs parallel to the track in a flat terrain. Through its central arrangement in the transverse direction the support unit can absorb a high bending moment with relatively low dead weight, so that the respectively prevailing stability requirements are fulfilled. In this case the support unit is integrated into the vehicle structure in a simple manner as a one-piece component. The assembly is therefore simplified within the context of the invention and is thus cost-effective. Furthermore the support unit is not, as in the prior art, solely provided to hold a vehicle reamer alone. Within the context of the invention, a climbing protection is also additionally provided by the support unit. For this purpose the support unit is equipped with climbing protection means, which are disposed on an end face surface of the plateau section of the support unit. The end face surface faces forward in the direction of travel. The plateau section advantageously extends in the transverse direction over the entire width of the rail vehicle and can thus be integrated into the vehicle structure as a cross member in a fixed manner. Moreover, the plateau section also extends in the longitudinal direction, wherein the retaining means likewise extend in that longitudinal direction, wherein a force-fit connection between plateau section and retaining means is provided in the longitudinal direction. This connection provides for a high bending moment.

Expediently, the plateau section extends in the transverse direction at least over the central third of the vehicle.

Expediently the track reamer holder is connected to the plateau section via retaining means, wherein the retaining means, the plateau section and the track reamer holder form a coupling cage, through which a coupling extends, so that stops for the coupling are provided through the coupling cage. In accordance with this advantageous development of the invention the support unit also serves as a limitation for the movement of a coupling which for example extends as a central coupling below the plateau section from the coupling cage delimited by the plateau section, the retaining means and the track reamer holder. The coupling cage thus limits the movement of the coupling.

The coupling cage expediently forms a jacking point, wherein the support unit has a stability such that a jacking of the rail vehicle is enabled at the jacking point. The jacking point is expediently an upper section of the coupling cage, which is for example equipped with a reinforcement profile on its side facing the plateau section. Said reinforcement profile is for example part of the plateau section. Otherwise, the reinforcement profile is disposed below the plateau section with little clearance and extends between the retaining means which form the lateral delimiting walls for the coupling cage. The rail vehicle can be easily rerailed by means of the jacking point.

Advantageously, the climbing protection means are designed as ribs, which protrude from an end face of the plateau section facing forward in the direction of travel. In the event of an impact, the ribs protruding forward on the end face side are brought into engagement with climbing protection means of the impact partner possibly designed in a corresponding manner, so that through this ribbed interleaving a climbing is prevented. Said ribs extend horizontally or in other words in the transverse direction and parallel to the track.

The plateau section expediently extends in the longitudinal and transverse direction, so that a horizontal surface is formed, on the underside of which the retaining means are fastened. Due to this flat design of the plateau section the entire construction of the support unit can provide a high bending moment and thus have a high stability despite a low mass. As a result, high forces can be absorbed by the support unit.

In accordance with a development which is expedient in this context, the retaining means are designed as reinforcement sheets which extend perpendicularly to the track, wherein side walls are formed in sections. The perpendicular sections of the retaining means thus laterally delimit the coupling cage, wherein they can extend over the entire length of the plateau section. The flat sides of the reinforcement sheets, that is to say their edges, are aligned forward in the direction of travel, wherein the front edges of the track reamer holder extend upward toward the plateau section. In doing so, further reinforcement ribs, which are for example attached to the respective side wall sections in the interior of the coupling cage, can be used. Said reinforcement ribs are for example also connected to the track reamer holder and to the lower side of the plateau section.

Moreover, within the context of the invention other profile supports for reinforcing the support unit are also provided within the context of the invention.

Further expedient embodiments and advantages of the invention are the subject matter of the following description of an exemplary embodiment of the invention with reference to the FIGURE of the drawing, wherein the

BRIEF DESCRIPTION OF THE SEVERAL VIEWS OF THE DRAWING

FIGURE shows a perspective view of an exemplary embodiment of the inventive rail vehicle.

DESCRIPTION OF THE INVENTION

The FIGURE shows a perspective view of a locomotive 1 as a rail vehicle. The locomotive 1 has a vehicle structure 2 which is supported on a chassis (not shown), which has wheel sets with wheels which roll on the rails of a track (likewise not shown in the FIGURE). The vehicle structure 2 comprises a car body 3 which is supported on an underframe. The underframe has longitudinal members 4 extending in the direction of travel as well as cross members running at right angles thereto. Recognizable on the end face of the locomotive 1 depicted in the FIGURE is a support unit 5, which forms a plateau section 6 which extends in a planar manner in the transverse direction and in the longitudinal direction, wherein the plateau section 6 is integrated into the underframe and thus into the vehicle structure 2 of the locomotive 1 in a fixed manner. In other words, the plateau section 6 is connected to longitudinal and cross members of the underframe in a fixed manner. Thus the support unit 5 and in particular the plateau section 6 is for example welded, or permanently connected in another manner, to the longitudinal member 4 and the driver's cab 7 extending above the plateau section 6. On a forward-facing end face surface 8 of the plateau section 6, ribs 9 are disposed which provide a climbing protection. In the event of an impact, the ribs 9 are brought into engagement with corresponding ribs of a locomotive approaching from the front, so that through this engagement a climbing of the locomotive and thus a derailment is prevented.

In addition to the plateau section 6, the support unit 5 possesses a track reamer holder 10, which is provided to hold and fasten clearing blades of a track reamer. The track reamer holder 10 is permanently connected to the plateau section 6 via retaining means 11, wherein the retaining means 11 possess reinforcement sheets 12 extending between the track reamer holder 10 and the plateau section 6, which reinforcement sheets 12 form side wall sections 13.

The side wall sections 13 extend between the track reamer holder 10 and the plateau section 6 as part of the reinforcement sheets 12 and thus as part of the retaining means 11. In doing so, a coupling cage 14 is formed which is delimited below by the track reamer holder 10 and laterally by the retaining means 11 in the form of the side wall sections 13. The upper limitation of the coupling cage 14 can for example be effected by the plateau section 6. In the exemplary embodiment shown in the FIGURE, however, a profile support 15 additionally extends in the transverse direction between the side wall sections 13 of the retaining means 11. This profile support 15 is permanently welded to the side wall sections 13 and is embodied in a particularly stable manner, so that a jacking point 16 is embodied in the center thereof, at which for example with the aid of a crane car the locomotive 1 can be jacked and thus rerailed. In a version of the invention differing herefrom the jacking point 16 is disposed on the track reamer holder 10, which then has a sufficient combined strength with the vehicle in order to jack the vehicle.

The coupling cage 14 serves to limit a movement of a center coupling (not shown in the FIGURE) which extends out of the rail vehicle 1 from a through opening 17 embodied further behind in the vehicle structure, through the coupling cage 14, forward in the direction of travel. The coupling serves for the coupling of further rail vehicles.

Due to the cage-like structure of the support unit 5, this has a high bending moment so that high forces can be absorbed without the support unit 5 needing to be manufactured from particularly thick material. The inventive rail vehicle 1, which is equipped with such a support unit 5, is therefore very lightweight.

The invention claimed is:

1. A rail vehicle, comprising:

a vehicle end face;

an underframe having a chassis;

a vehicle structure including a driver's cab and a car body supported on said underfame;

a support unit disposed on said vehicle end face, said support unit having a plateau section being part of said vehicle structure and being welded to said chassis of said underframe;

said plateau section having a plateau section end face and a climbing protection device disposed on said plateau section end face;

said driver's cab extending above said plateau section and being welded to said plateau section; and a track reamer holder disposed below said plateau section for holding a track reamer, said track reamer holder being fixedly connected to said plateau section;

a retaining device connecting said track reamer holder to said plateau section;

said retaining device, said plateau section and said track reamer holder forming a coupling cage configured for extending a coupling through said coupling cage and for providing stops for the coupling through said coupling cage.

2. The rail vehicle according to claim 1, wherein said coupling cage forms a jacking point, and said support unit provides stability to enable jacking of the rail vehicle at said jacking point.

3. The rail vehicle according to claim 1, wherein said plateau section extends in longitudinal and transverse directions to form a horizontal surface having an underside on which said retaining device is fastened.

* * * * *